US006007922A

United States Patent [19]

Sue et al.

[11] Patent Number: 6,007,922

[45] Date of Patent: Dec. 28, 1999

[54] CHROMIUM BORIDE COATINGS

[75] Inventors: Jiinjen Albert Sue, Indianapolis; Robert Clark Tucker, Jr., Brownsburg; Joseph Patrick Nemeth, Indianapolis, all of Ind.

[73] Assignee: Union Carbide Coatings Service Corporation, Danbury, Conn.

[21] Appl. No.: 06/651,789

[22] Filed: Sep. 18, 1984

[51] Int. Cl.[6] ..... B22F 7/04; B05D 5/00

[52] U.S. Cl. ..... 428/561; 428/556; 428/564; 428/704; 427/123; 427/287; 75/244

[58] Field of Search ..... 428/552, 556, 428/564, 688, 704; 75/244, 254; 427/123

[56] References Cited

U.S. PATENT DOCUMENTS

| | | | |
|---|---|---|---|
| 3,970,445 | 7/1976 | Gale et al. | 428/558 |
| 4,011,051 | 3/1977 | Helton et al. | 419/12 |
| 4,101,319 | 7/1978 | Beyer et al. | 428/553 |
| 4,113,920 | 9/1978 | Helton et al. | 75/238 |
| 4,185,136 | 1/1980 | Wasserman et al. | 428/561 |
| 4,401,724 | 8/1983 | Moskowitz et al. | 428/564 |
| 4,469,532 | 9/1984 | Nicolas | 148/134 |
| 4,485,148 | 11/1984 | Rashid et al. | 428/656 |
| 4,513,062 | 4/1985 | Suzuki et al. | 428/565 |

*Primary Examiner*—Peter A. Nelson
*Attorney, Agent, or Firm*—Cornelius F. O'Brien

[57] ABSTRACT

A new family of chromium boride coatings having excellent adhesive wear and corrosion resistance is disclosed. The coatings comprise hard, ultrafine, chromium boride particles dispersed in a metal matrix, the particles having an average particle size of less than one micron and constituting less than about 30 volume percent of the coating, the balance being metal matrix. The metal matrix may be composed of nickel or a nickel base alloy containing a metal selected from the group consisting of chromium, silicon and iron. The coatings may be prepared by a process which comprises depositing a mechanically blended powder mixture of chromium metal or a chromium alloy or mixture of both, and a boron-containing alloy onto a substrate and then heat treating the as-deposited coating. The heat treatment effects a diffusion reaction between the deposited elements resulting in the formation of ultrafine particles of chromium boride dispersed in a metal matrix. The coating can be deposited onto the substrate using any of the known deposition techniques.

45 Claims, 8 Drawing Sheets

CHROMIUM BORIDE COATINGS

RELATED APPLICATIONS

Copending application Ser. Nos. 651,690 and 651,688 filed on even date herewith and assigned to the common assignee hereof disclose subject matter which is related to the present invention.

BACKGROUND OF THE INVENTION

1. Field of the Invention

The present invention relates to chromium boride coatings having excellent adhesive wear and corrosion resistance and to a process for preparing such coatings. More particularly, the invention relates to hard, dense, low-porosity, wear and corrosion resistant coatings containing ultrafine chromium boride particles dispersed in a metallic matrix. The invention also relates to a process for preparing such coatings in situ by thermal spray and diffusion reaction techniques.

Throughout the specification, reference will be made to plasma arc spraying and detonation gun (D-Gun) techniques for depositing coatings. Typical detonation gun techniques are disclosed in U.S. Pat. Nos. 2,714,563 and 2,950,867. Plasma arc spraying techniques are disclosed in U.S. Pat. Nos. 2,858,411 and 3,016,447. Other thermal spray techniques are also known, for example, so called "high velocity" plasma and "hypersonic" combustion spray processes, as well as the various flame spray processes. Heat treatment of the coatings is necessary and may be done after deposition in a vacuum or inert gas furnace or by electron beam, laser beam, induction heating, transferred plasma arc or other techniques. Alternative deposition techniques such as slurries, filled fabrics or electrophoresis, followed by heat treatment, are also known. Still other methods include simultaneous deposition and fusion utilizing plasma transferred arc, laser or electron beam surface fusion with or without post deposition heat treatment.

2. Background Art

In the petroleum industry, mechanical gate valves are commonly used for handling a variety of corrosive liquids under high hydraulic pressures. During operation of these valves, the gate is required to move against a valve seat quite rapidly under high mechanical force in order to close and seal the valve. Such conditions create severe adhesive and erosive wear on the metallic surfaces of both the gate and valve seat which can lead to early failure of the valve.

It is common practice in the petroleum industry to employ mechanical gate valves having adhesive and erosive resistant coatings applied to the mating metallic gate and valve seat surfaces. Due to differences in substrate materials and types of wear mechanism involved, the coatings applied to the gate and valve seat surfaces are usually different. For example, a detonation gun tungsten carbide based coating has been used successfully to protect the metallic gate surfaces against adhesive wear while the valve seat has been protected by a Ni-Cr-B-Si-Fe alloy applied as an overlay by known welding techniques.

A problem with these particular coating combinations has been that the valve seat coating is not compatible with many heat treated and hardenable alloys which are useful as substrate materials. For example, a conventional Ni-Cr-B-Si-Fe coating alloy, when applied as an overlay to a valve seat made of AISI 410 stainless steel or AISI 4130 steel usually fails by cracking or spalling after heat treatment. This is due to a mismatch in expansion rates between the substrate and coating. Accordingly, there is a present need to develop new coatings which can be employed with a greater variety of substrate materials.

SUMMARY OF THE INVENTION

According to the present invention, there is provided a new family of chromium boride coatings having excellent adhesive wear and corrosion resistance and which are compatible with a number of alloy substrates. These coatings comprise hard, ultrafine, chromium boride particles dispersed in a metallic matrix, the particles constituting less than about 30 volume percent of the coating, the balance being metal matrix. The atomic ratio of chromium metal to boron in the coating is between about 0.8 and 1.5. The metal matrix may be composed of nickel or a nickel base alloy containing a metal selected from the group consisting of chromium, silicon and iron.

The coatings of the present invention may be prepared by process which comprises depositing a mechanically blended powder mixture of chromium metal or a chromium alloy or mixture of both, and a boron-containing alloy onto a substrate and then heat treating the as-deposited coating. The heat treatment effects a diffusion reaction between the deposited elements resulting in the formation of ultrafine particles of chromium boride dispersed in a metal matrix. The coating can be deposited onto the substrate using any of the known deposition techniques mentioned earlier.

DESCRIPTION OF THE PREFERRED EMBODIMENT

Figure 1:
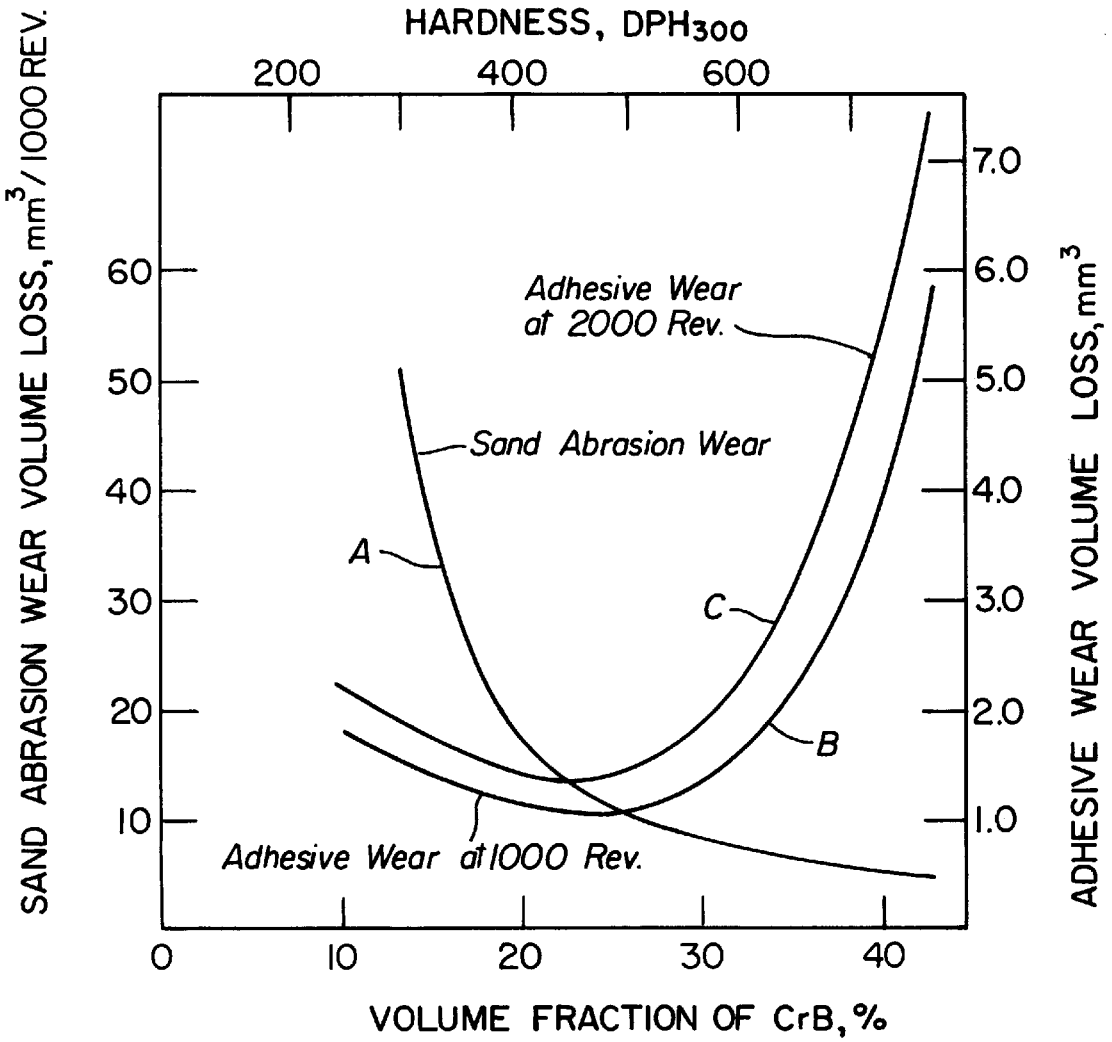
FIG. 1 is a group of curves showing the relationship between hardness, abrasive and adhesive wear and the volume fraction of CrB particles in a coating according to the present invention.

The coatings of the present invention are preferably applied to a substrate using thermal spray processes. In one such process, i.e. plasma spraying, an electric arc is established between a non-consumable electrode and a second non-consumable electrode spaced therefrom. A gas is passed in contact with the non-consumable electrode such that it contains the arc. The arc-containing gas is constricted by a nozzle and results in a high thermal content effluent. The powdered coating material is injected into the high thermal content effluent and is deposited onto the surface to be coated. This process and plasma arc torch used therein are described in U.S. Pat. No. 2,858,411. The plasma spray process produces a deposited coating which is sound, dense, and adherent to the substrate. The deposited coating consists of irregularly shaped microscopic splats or leaves which are interlocked and mechanically bonded to one another and also to the substrate.

Another method of applying the coatings to a substrate is by detonation gun (D-Gun) deposition. A typical D-Gun consists essentially of a water-cooled barrel which is several feet long with an inside diameter of about one inch. In operation, a mixture of oxygen and a fuel gas, eg. acetylene, in a specified ratio (usually about 1:1) is feed into the barrel along with a charge of powder to be coated. The gas is then ignited and the detonation wave accelerates the powder to about 2400 ft./sec. (730 m/sec.) while heating the powder close to or above its melting point. After the powder exits the barrel, a pulse of nitrogen purges the barrel and readies the system for the next detonation. The cycle is then repeated many times a second.

The D-Gun deposits a circle of coating on the substrate with each detonation. The circles of coating are typically about one inch (25 mm) in diameter and a few ten thousandths of an inch (i.e. several microns) thick. Each of circle coating is composed of many overlapping microscopic splats corresponding to the individual powder particles. The overlapping splats are interlocked and bond to each other and to the substrate without substantially alloying at the interface thereof. The placement of the circles in the coating deposition are closely controlled to build-up a smooth coating of uniform thickness and to minimize substrate heating and residual stresses in the applied coating.

As a general rule, the powdered coating material used in the thermal spray process will have essentially the same composition as the applied coating itself. With some thermal spray equipment, however, changes in composition may be expected. In such cases the powder composition will be adjusted accordingly to achieve the desired coating composition.

Although the present invention will be described hereinafter with particular reference to coatings prepared by plasma arc spray processes, it will be understood that any of the known deposition techniques described earlier can also be employed.

According to the present invention, wear and corrosion resistant coatings are applied to a metallic substrate by plasma spraying a mechanically blended powder mixture containing particles of chromium metal or chromium alloy or mixture of both and a boron-containing alloy or mixture of alloys, followed by heat treatment at elevated temperatures, eg, from about 900 to about 1100° C. At these temperatures, diffusion and chemical reactions occur between the thin overlapping splats deposited by the thermal spray process, some of which contain the chromium metal component and others of which contain the boron-containing alloy or mixture of alloys. These diffusion and chemical reactions result in the formation of chromium boride (CrB) precipitates which are dispersed in a metal matrix. The precipitates are usually dispersed uniformly throughout the matrix, although in some cases they may be aggregated in small clusters which are evenly distributed in the matrix. Essentially no reaction takes place between the powder particles during deposition so that the splats, before heat treatment, retain their initial powder composition.

The coatings of the present invention may be prepared using a two component system, that is, a first chromium metal or chromium alloy component and a second boron-containing alloy component or alternatively, a multiple component system may be employed. The multiple component system may include additional chromium metal or chromium alloy and may be used in those cases where it is desirable to incorporate chromium metal in the alloy matrix, for example, to increase corrosion resistance.

The formation of coatings containing chromium boride precipitates in a metal matrix may proceed according to one of the following equations:

$$Cr+(M_1—B)\rightarrow CrB+M_1 \quad (1)$$

$$(M_2—Cr)+(M_1—B)\rightarrow CrB+(M_1—M_2) \quad (2)$$

$$Cr+(M_1—B)+(M_2—Cr)\rightarrow CrB+(M_1—M_2—Cr) \quad (3)$$

wherein $M_1$ and $M_2$ are nickel and optionally one or more metals selected from the group consisting of chromium, silicon, phosphorus, aluminum, manganese, cobalt and iron; and;

B is boron.

As indicated above, the purpose of the metal $M_2$ is to modify the properties of the matrix, e.g., to include additional chromium in order to improve the corrosion resistance.

In addition to the elements mentioned, $M_1$ and $M_2$ may also contain small amounts of other elements such as carbon, oxygen and nitrogen.

The proportion of chromium metal and boron used in the powder mixture determines the volume fraction of the chromium borides that precipitates in the metal matrix. Generally, the ratio should be kept in a range from about 0.8 to about 1.5.

For optimum adhesive wear properties, the volume fraction of chromium boride precipitates in the coating should be maintained in a range of from about 12 to about 30 volume percent, preferable from about 15 to 25 volume percent.

The coatings can be prepared with a volume fraction of chromium borides in the above ranges if the elements in the boron-containing alloy are kept within the following proportions: from about 2.5 to about 10 wt. % boron, 0 to about 25 wt. % chromium, 0 to about 2 wt. % manganese, 0 to about 2 wt. % aluminum, 0 to about 1 wt. % carbon, 0 to about 5 wt. % silicon, 0 to about 5 wt. % phosphorus, 0 to about 2 wt. % copper and 0 to about 5 wt. % iron, the balance being nickel.

Most any boron-containing alloy can be used to prepare coatings according to the present invention so long as the alloy satisfies the reaction requirements for one of the Equations (1)–(3) above as well as providing the desired elements in the metal matrix. Alloys which are particularly suited for use in preparing coatings according to the present invention are given in Table I below.

TABLE I

BORON-CONTAINING ALLOYS

| | Composition (weight %) | | | | |
|---|---|---|---|---|---|
| Alloy No. | Ni | B | Cr | Si | Fe |
| 1 | Balance | 3 | 7 | 4 | 4 |
| 2 | Balance | 7.3 | 3.2 | 2.6 | |
| 3 | Balance | 8.9 | 3.0 | 2.2 | 2.7 |

Generally, the powder mixture used to prepare the coatings has a particle size of less than about 200 mesh.

It is important in the practice of the present invention to heat treat the as-deposited coating at a sufficiently elevated temperature for the boron-containing alloy to be fluid enough to promote the diffusion reaction, typically about 900° C. The heat treatment temperature can be substantially higher than 900° C. if desired, e.g. about 1100° C., but the temperature should not be so high as to detrimentally effect the substrate. The as-deposited coating should be maintained at the heat treatment temperature for times sufficient to promote the reaction and/or diffusion between the components of the coating. A limited, but important, amount of diffusion reaction occurs also with the substrate.

The heat treatment of the coating is generally carried out in a vacuum or an inert gas furnace. Alternatively, the heat treatment can be achieved by surface fusion processes such as electron beam, laser beam, transferred plasma arc, induction heating or other technique so long as the time at elevated temperature is sufficiently short or a protective atmosphere is provided such that no significant oxidation of the coating occurs.

The coatings of the present invention can be applied with success to many different types of substrates using the known deposition techniques described above. However, the substrate must be able to withstand the effects of heat treatment without any harmful result. Suitable substrate materials which can be coated according to the present invention include, for example, steel, stainless steel, iron base alloys, nickel, nickel base alloys, cobalt, cobalt base alloys, chromium, chromium base alloys, titanium, titanium base alloys, refractory metals and refractory-metal base alloys.

In those instances where a coating according to the present invention is applied to a heat treated and hardenable alloy substrate such as AISI 4140/4130 steel, for example, the volume fraction of the hard phase can be as high as 20 percent or more. In the case where a coating is applied to AISI 410[1] stainless steel, the volume fraction of hard phase should be kept below about 20 percent. It has been found that the coatings having a volume fraction of CrB above these levels are not ductile enough to withstand the high internal stresses imposed by expansion of the substrate. This is a particularly troublesome problem with some alloys such as AISI 410 which undergo thermal expansion through the martensite phase transformation.

[1]The nominal composition of AISI 410 is 12.5 wt. % Cr, 0.15 wt. % max. C, balance iron, while that of AISI 4130 is 0.3 C, 0.5 Mn, 0.2 Si, 1.0 Cr, 0.2 Mo, balance iron, and AISI 4140 is 0.4 C, 0.9 Mn, 0.2 Si, 1.0 Cr, 0.2 Mo, balance iron.

The thickness of coatings prepared according to the present invention generally varies from about 0.005 to about 0.040 inch (0.1 to 1.0 mm).

The microstructures of the coatings of the present invention are somewhat complex and not fully understood. However, it is known from studies so far conducted that the coatings contain a hard phase comprising ultrafine particles of chromium boride in a metal matrix. The metal matrix is essentially crystalline, relatively dense, softer than the hard phase and has a low permeability.

Depending upon the volume fraction of the hard phase in a coating, the chromium boride particles may be dispersed in a substantially uniform manner throughout the matrix or the particles may be aggregated in small clusters which are usually distributed evenly in the matrix. Generally, clusters of CrB particles are formed in the coatings as the volume fraction approaches the upper limit of about 30 volume percent.

The size of the chromium boride particles will vary depending upon several factors including the heat treatment temperature and time. Generally, the average particle size will be sub-micron, typically from about 0.1 to about 1.0 micron.

The hardness of the coatings varies in proportion to the volume fraction of the hard phase. It is possible, therefore, to tailor the hardness to a particular range of values by varying the atomic ratio of chromium metal to boron within the powder mixture. Generally, the hardness of the coatings ranges from about 250 to about 700 $DPH_{300}$ (HV.3).

An important advantage of the present invention is that the diffusion reaction between chromium or chromium alloy and the boron-containing alloy takes place at relatively low heat treatment temperatures, eg about 1000° C. Although the exact reason for this phenomenon is not understood, it is believed to be due to the build-up of high internal stresses and dislocations inside the lamellar splats or leaves that are deposited onto the substrate by thermal spraying. In contrast, chromium borides have been formed by conventional casting or hot pressed methods at significantly higher temperatures greater than about 1150° C. These higher temperatures are usually detrimental to most steels. Due to the low heat treatment temperatures required in the present coating process, these substrates can now be coated without any harmful effects.

The following examples will serve to further illustrate the practice of the present invention.

EXAMPLE I

A number of CrB coatings were prepared by plasma spraying powder mixtures of an alloy of nickel-20 chromium and Alloy No. 2 onto low carbon AISI 1018[2] steel specimens measuring ½×¾×2-¾ inches (13×19×70 mm), AISI 410 stainless steel specimens measuring ⅝×1×2(16×25×51 mm), Inconel 718[3] superalloy specimens measuring ½×1×2-¾(13×25×70 mm) and AISI 4140 and AISI 4130 alloy steel specimens measuring ½×1×2-¾ inches to a thickness of about 0.020 inch (0.5 mm). The Cr to B atomic ratio in the powder mixture was about 1. The as-deposited coatings were heat treated for one hour at temperatures of from about 970 to 1020° C. in vacuum or argon, followed by a sequence of heat treatments, depending upon the substrate material. The as-coated and heat-treated coatings had an apparent porosity of less than about 0.5 percent. In the heat-treated coating, the very fine CrB precipitates were uniformly dispersed throughout a Ni-Cr-Si-Fe matrix. The interdiffusion zone of the coating/substrate had a thickness of about 30 to 40 micrometers.

[2]The nominal composition of AISI 1018 is 0.18 C, balance Fe and Inconel 718 is 19 Cr, 3.0 Mo, 5.1 Nb, 0.9 Ti, 0.5 Al, 18.5 Fe, 0.08 C max, balance Ni.
[3]"Inconel" is a trademark of International Nickel Company.

A series of heat treatment experiments were conducted on the coated specimens in a horizontal furance, equipped with an oil quench apparatus and with a 10 cfh static flow of argon gas. The heat treatments applied to the coating/substrate systems are outlined in Table II below.

TABLE II

Heat Treatment Schedules

Coating/410 SS (1) Heat treated at 1000° C./1 hr./Ar, furnace cool to 940° C., hold at 940° C./15 min./Ar, fan cool in Ar.

(2) Temper at 700° C./45 min./Ar oil quench, and temper at 685° C./45 min./Ar, oil quench.

Coating/Inco 718

(1) Heat treat at 1000° C./1 hr./Ar, fan cool in Ar.

(2) Age at 700° C./4 hrs./Ar, fan cool in Ar.

Coating/4140

(1) Heat treat at 1000° C./1 hr./Ar, oil quench.

(2) Temper at 600° C./1 hr./Ar, oil quench.

or, temper at 450° C./1 hr./Ar, oil quench.

or, temper at 350° C./1 hr./Ar, oil quench.

In Table II above, the first heat treatment step (1) promotes the diffusion reaction in the coating, while the second heat treatment step (2) achieves the desired mechanical properties of the substrate.

Metallographic examination and penetrant techniques were employed to reveal any defects in the coating or substrate after completion of the heat treatment cycles. It was found that the coatings were essentially uneffected by the second heat treatment except for the coatings on the AISI 410 stainless steel which showed evidence of cracking.

In subsequent experiments with this same coating on 410 stainless steel, crack-free coatings were produced by making adjustments in the heat treatment schedule. However, this modification requires very precise control of heat treatment which makes it unsuitable for actual use in production.

EXAMPLE II

A number of CrB coatings were prepared by plasma spraying powder mixtures of nickel-20 chromium and Alloy No. 1 onto AISI 410 stainless steel measuring ⅝×1×2 inches (16×25×51 mm) to a thickness of about 0.020 inch (0.5 mm). The mixture formulation was as follows: Alloy No. 1+39.3 (Ni-20 Cr). All compositions will be expressed hereinafter in weight percent, eg. 60.7 wt. % Alloy No. 1+39.3 wt. % (Ni-20 Cr) equals Alloy No. 1+39.3 (Ni-20Cr). The Cr to B atomic ratio was about 1.4. The as-deposited coatings were heat treated for one hour at temperatures of about 970 to 1020° C. in vacuum or argon. The coatings consisted of CrB precipitates uniformly dispersed throughout a Ni-Cr-Si-Fe matrix.

The volume fraction of the CrB precipitates in these coatings was 15.5 volume percent. This was less than volume percent of precipitates in the coatings of Example I.

The coatings prepared in this example were subjected to the same heat treatment schedule for the AISI 410 stainless steel substrate as outlined in Table II. After the heat treatment, the coatings were examined and found to contain no cracks or defects, indicating that this particular coating was compatible with the 410 stainless steel substrate.

The hardness of these CrB coatings was about 340 $DPH_{300}$ (HV.3). This was less than the hardness of the coatings prepared in Example I; however, the instance coatings were more ductile and strain resistant.

EXAMPLE III

A number of CrB coatings were prepared by plasma spraying powder mixtures of chromium metal or nickel-20 chromium and a boron-containing alloy onto AISI 1018 steel specimens measuring ¾×½×2-½ inches to a thickness of about 0.020 inch (0.5 mm). The powder mixtures were based on the formulation of stoichiometric CrB in the coating such that the calculated chromium boride volume fraction varied from about 13.4 to 42.6 percent. The mix formulations were as follows:

(1) Alloy No. 1+50 (Ni-20Cr)

(2) Alloy No. 1+39.3 (Ni-20Cr)

(3) Alloy No. 2+56 (Ni-20Cr)

(4) Alloy No. 3+35 (Ni-20Cr)+15Cr (5) Alloy No. 3+30Cr The as-deposited coatings were heat treated for one hour at temperatures of from about 960 to 1020° C. in vacuum or argon, followed by oil quench. The coatings consisted of fine CrB precipitates in a Ni-Cr-Si-Fe. The calculated volume fraction of the hard phase in the coatings prepared from each formulation (1) to (5) was 13.4, 15.5, 19.7, 32.5 and 42.6 percent, respectively.

The hardness of the CrB coatings varied from about 280 to 740 $DPH_{300}$ (HV.3).

For comparison, a number of coatings were made from conventional alloy powders designated herein as Cl, a brazing alloy (Alloy No. 1) and C2 were prepared by plasma spraying the alloy powder onto the same AISI 1018 steel specimens, then heat treating the as deposited coating in the same manner as described above. Coatings made from another conventional alloy powder (Ni-Cr-B-Si-Fe) designated herein as C3 were applied onto the steel specimens using standard weld deposition techniques.

Table III below lists the nominal compositions for all the coatings:

TABLE III

| | Total Composition (wt. %) | | | | | |
|---|---|---|---|---|---|---|
| Coating Formulation (wt. %) | Ni | Cr | B | Si | Fe | C |
| (1) Alloy No. 1 + 50 (Ni—20Cr) | 81.5 | 13.5 | 1.5 | 2.0 | 1.5 | <0.25 |
| (2) Alloy No. 1 + 39.3 (Ni—20Cr) | 81.83 | 12.1 | 1.82 | 2.43 | 1.82 | <0.30 |
| (3) Alloy No. 2 + 56 (Ni—20Cr) | 83.39 | 12.87 | 2.64 | 1.1 | — | 0.02 |
| (4) Alloy No. 3 + 35 (Ni—20Cr) + 15Cr | 69.3 | 23.6 | 4.7 | 1.3 | 1.1 | — |
| (5) Alloy No. 3 + 30Cr | 57.68 | 32.24 | 6.79 | 1.82 | 1.47 | — |
| (6) C1 | 82.95 | 7.0 | 3.0 | 4.0 | 3.0 | <0.05 |
| (7) C2 | 70.5 | 17.0 | 3.5 | 4.0 | 4.0 | 1.0 |
| (8) C3 | 77.35 | 11.5 | 2.5 | 3.75 | 4.25 | 0.65 |

It should be noted from Table III that the composition of coatings prepared from mix formulations (2) and (3) correspond closely to the composition of the conventional coatings, particularly coating C3. Although the composition of coatings prepared according to the present invention are similar to those of conventional coatings, microscopically the structures of these coatings are significantly different.

Abrasive wear properties of the coatings prepared above were determined using a standard dry sand/rubber wheel abrasion test described in ASTM Standard G65-80 Procedure A. In this test, the coated specimens were loaded by means of a lever arm against a rotating wheel with a chlorobutyl rubber rim around the wheel. An abrasive (i.e., 50-70 mesh Ottawa Silica Sand) was introduced between the coating and the rubber wheel. The wheel was rotated in the direction of the abrasive flow. The test specimens were weighted before and after the test and their weight loss was recorded. Because of the wide differences in the densities of different materials tested, the mass loss is normally converted to volume loss to evaluate the relative ranking of the materials. The average volume loss for coatings of the present invention ranged from about 5 to 50 $mm^3$/1000 revolutions. The volume loss was found to decrease with increasing volume fraction of the hard phase in the coatings.

The CrB coatings were also subjected to erosion tests. These tests were conducted according to standard procedures using alumina particles with a nominal size of 27 microns and a particle velocity of about 91 meters per sec at two impingement angles of 900° and 300°. The average erosion rate was found to be about 60 to 120 and about 30 to 37 micrometers per gram, respectively.

The dry adhesive wear resistance of both the chromium boride and the conventional coatings was evaluated using a block-on-ring (alpha) tester. A coated ring having a detonation gun (W,Cr)C-Co coating produced by Union Carbide Corp. under the designation UCAR[4]LW-15, was rotated against a stationary block coated with the test coatings. The test conditions were fixed at 80° oscillation, 1000 and 2000 cycles, 164 Kg (360 lbs.) normal load and 18 m/min. (60 ft./min.) rotating speed in dry air at room temperature. The adhesive wear resistance of the coating was determined by measuring the volume loss based on measurements of wear, scar length and width on the block and weight loss on the ring. The coatings prepared with mix formulations (1) to (3), inclusive, exhibited a weight loss of about 1.3 $mm^3$ while the conventional coatings exhibited a weight loss of over 2.0 $mm^3$, both at 1000 cycles test. At the 2000 cycles test, the respective weight losses were 1.4 to 1.9 and 1.8 to 3.4 $mm^3$.

[4]"UCAR" is a trademark of Union Carbide Corp.

Figure 3A:
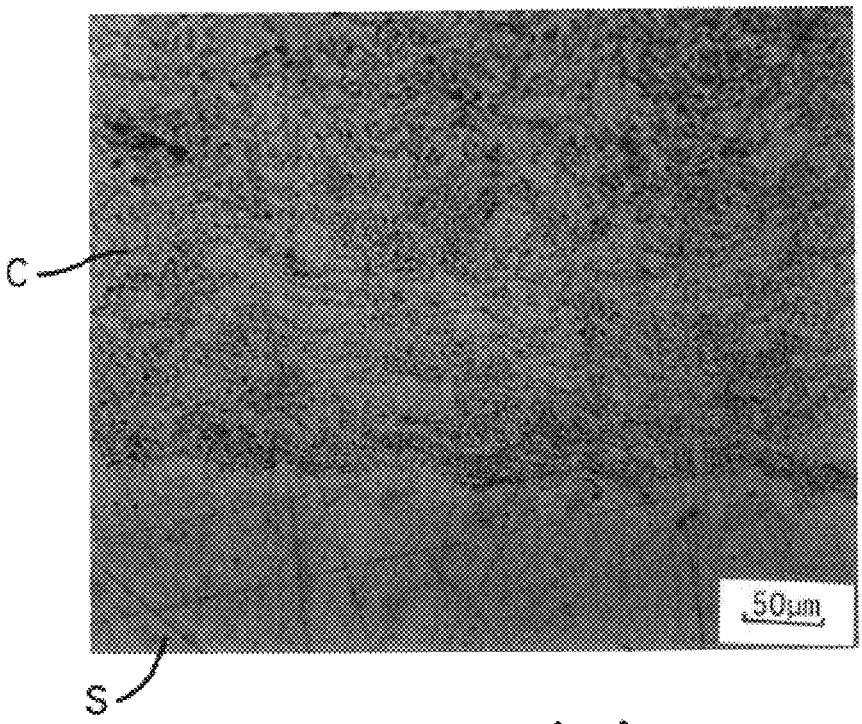
FIGS. 3(*a*) and (*b*) through FIGS. 7 (*a*) and (*b*), inclusive, are photomicrographs taken at a magnification of 200× showing the microstructures of sections perpendicular and parallel, respectively, to the surface of typical CrB coatings of present invention prepared with different volume fractions of hard phase.
Figure 3B:
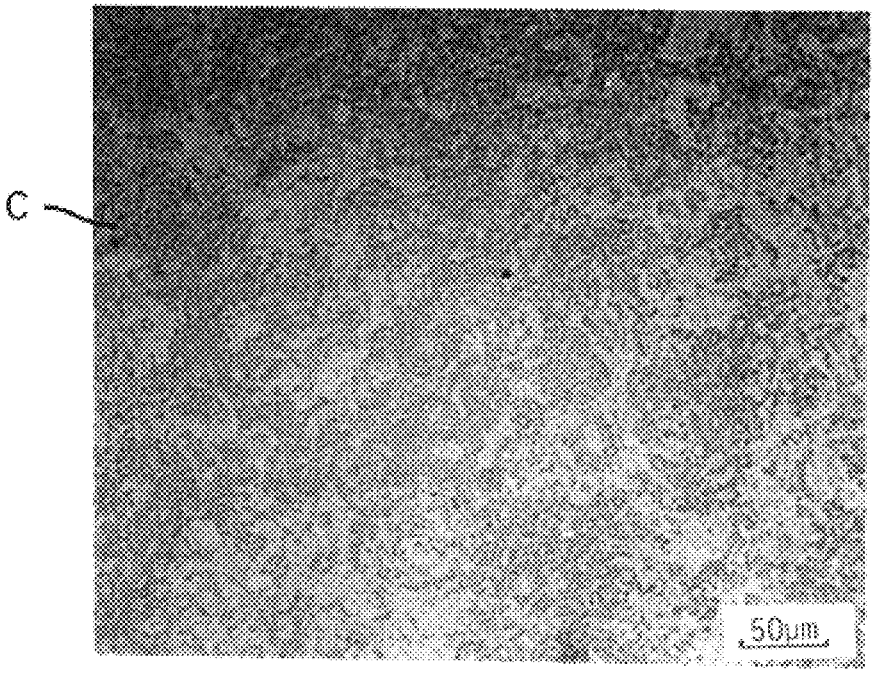
Figure 4A:
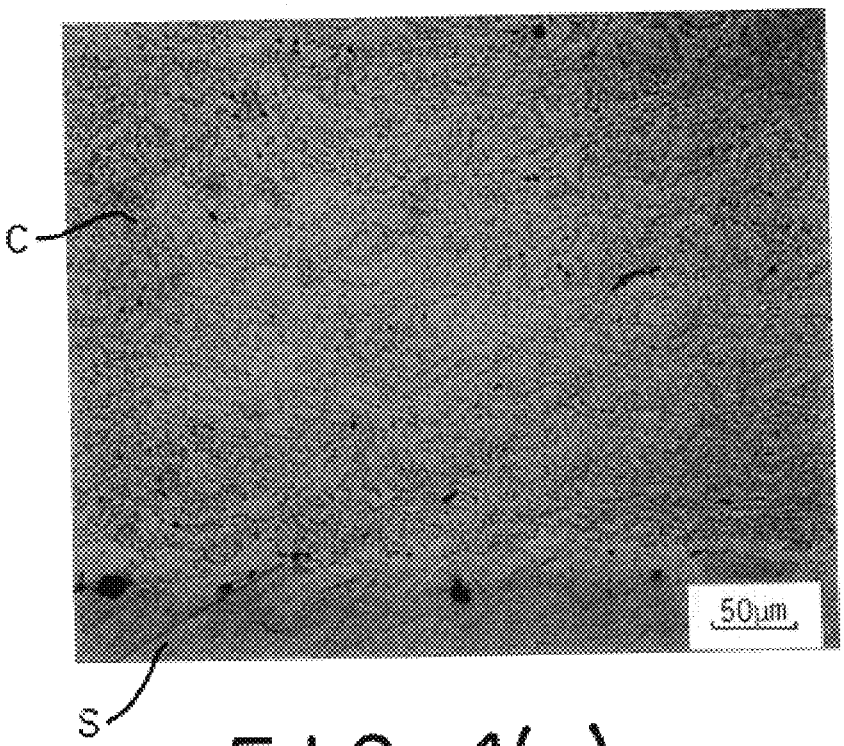
Figure 4B:
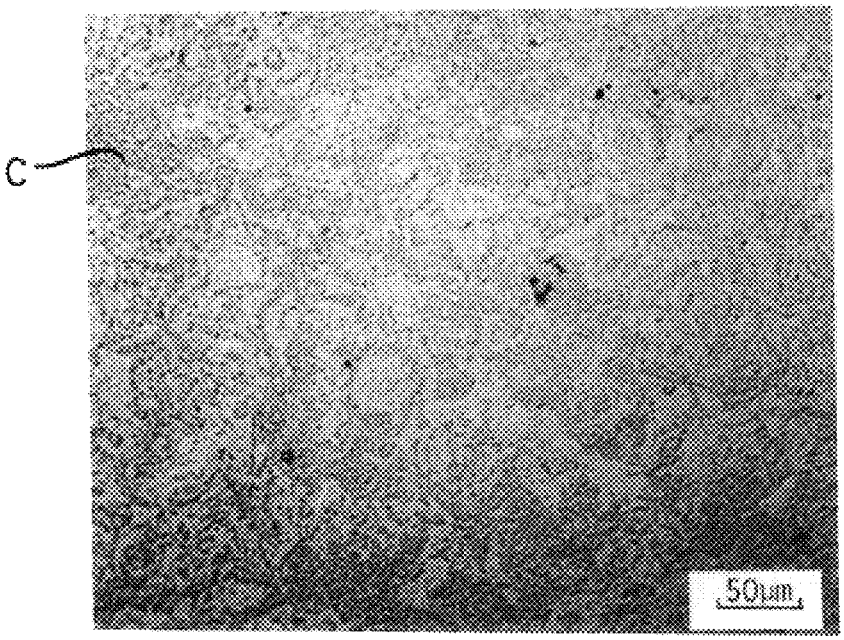
Figure 5A:
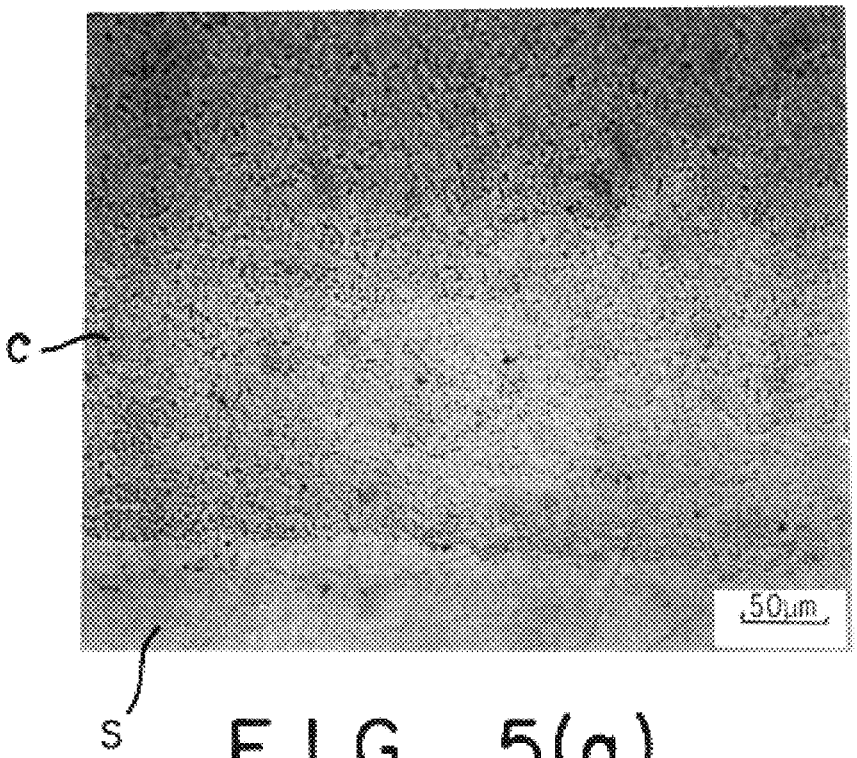
Figure 5B:
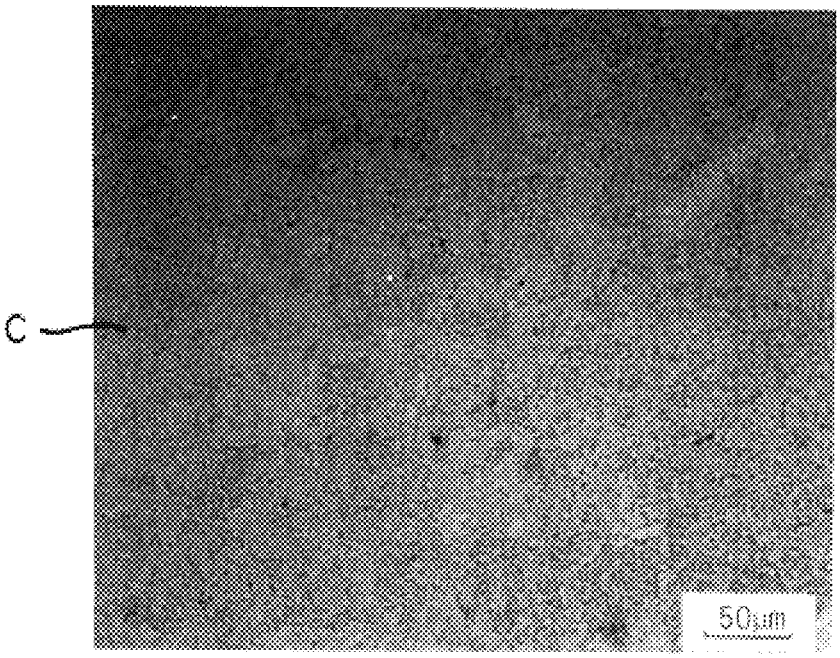
Figure 7A:
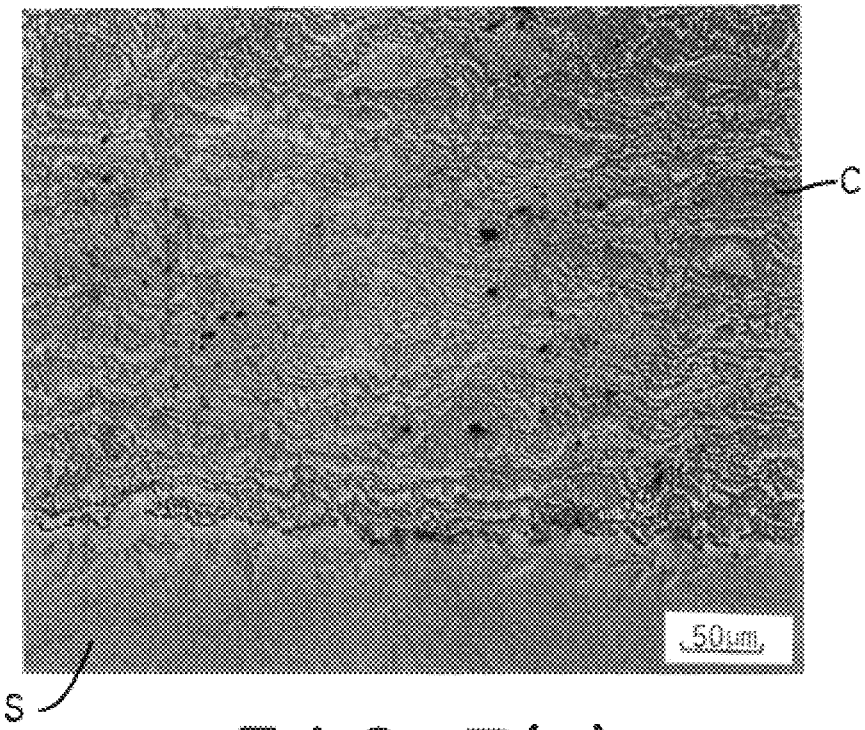
Figure 7B:
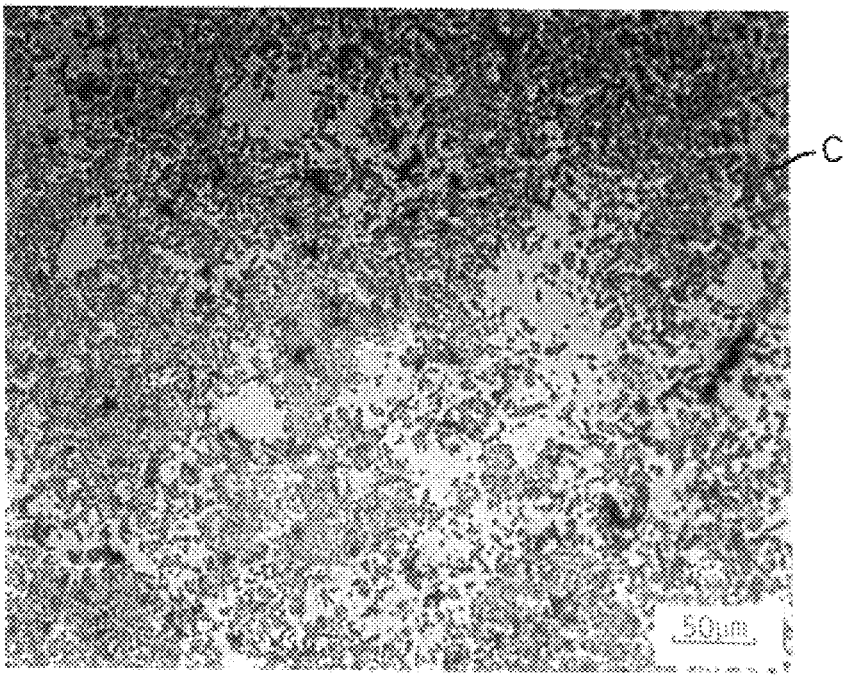

Table IV summarizes the metallographic evaluation, sand abrasion, erosion and adhesive wear resistance of all the coatings tested.

to the surface of a series of chromium boride coatings made from mix formulations (1) to (5) are shown in FIGS. 3(*a*) and (*b*) through FIGS. 7(*a*) and (*b*), inclusive. The volume fraction of chromium boride in the coatings prepared from these mix formulations (1) to (5) ranges from 13.4 to 42.6%.

In all the photomicrographs, C refers to the coating, S refers to the substrate, the dark areas are precipitates and the light areas are matrix.

The microstructures of the sections perpendicular to the surface of the coatings reveal that the precipitates of chromium boride are dispersed substantially uniformly throughout the matrix in the case of the coatings made from mix formulations (1), (2) and (3) having a volume fraction of

TABLE IV

Results of Metallographic Evaluation, Sand Abrasion, Erosion and Adhesive Wear Resistances of CrB Coatings and Conventional Alloy Coatings

| Coating | Oxides | Apparent Porosity % | Hardness ($VPN_{300}$) | Calculated Vol. Fraction of CrB (%) | Sand Abrasion Wear ($mm^3$/1000 Rev.) | Alumina Erosion (m/g) 90° | Alumina Erosion (m/g) 30° | Adhesive Wear Against LW-15 Vol. loss ($mm^3$) Coatings/LW-15 360 lb., 1000 Cycles | Adhesive Wear Against LW-15 Vol. loss ($mm^3$) Coatings/LW-15 360 lb., 2000 Cycles |
|---|---|---|---|---|---|---|---|---|---|
| Alloy No. I + 50 (Ni—20Cr) | nil | 0.2 | 284 ± 19 | 13.4 | 46.9 | 58.8 | 32.5 | 1.3/0.04 | 1.86/0.11 |
| Alloy No. I + 39.3 (Ni—20Cr) | nil | 0.1 | 344 ± 18 | 15.5 | 39.4 | 55.2 | 30.4 | 1.4/0.24 | 1.70/0.08 |
| Alloy No. 2 + 56 (Ni—20Cr) | trace | 0.25 | 407.38 | 19.7 | 15.2 | 79.8 | 30.9 | 1.25/0.09 | 1.41/0.11 |
| Alloy No. 3 + 35 (Ni—20Cr) + 15Cr | nil | 0.25 | 604 ± 65 | 32.5 | 11.2 | 76.0 | 32.0 | 1.4/0.21 | 1.92/0.052 |
| Alloy No. 3 + 30Cr | trace | 1.5 | 740 ± 85 | 42.6 | 4.7 | 121.8 | 38.3 | 5.4/0.64 | 7.0/0.71 |
| C1 | trace | 0.1 | 731 ± 26 | — | 16.5 | 97.2 | 39.8 | — | 2.45/0.56 |
| C2 | nil | 0.4 | 743 ± 92 | — | 5.8 | 92 | 35 | 2.14/0.78 | 3.43/1.02 |
| C3 | trace | 0.25 | 565 ± 67 | 18 | 8.1 | 73.9 | 33.9 | 2.2/0.55 | 1.8/0.32 |

The group of curves in FIG. 1 show the relationship between hardness, abrasive and adhesive wear and the chromium boride volume fraction in coatings prepared according to the present invention. The curves are based on average values of test results obtained on various CrB coatings prepared in this example. It should be noted first that the hardness of the coatings is linearly proportional to the CrB volume fraction. The sand abrasion wear rate of the coatings is represented by curve A. It will be seen that the sand abrasion wear rate is non-linear and varies inversely with the volume fraction of chromium boride. The adhesive wear rate at 1000 cycles is represented by curve B and at 2000 cycles by curve C. The adhesive wear rate increases non-linearly with increasing boride content in the coating. The coatings exhibit a higher adhesive wear rate when tested at 2000 cycles. It should also be noted that minimum volume loss occurs with coatings having a chromium boride volume fraction of between about 12 and 30 percent. Coatings having a volume fraction greater than about 30 percent show a significant increase in volume loss.

Figure 2:
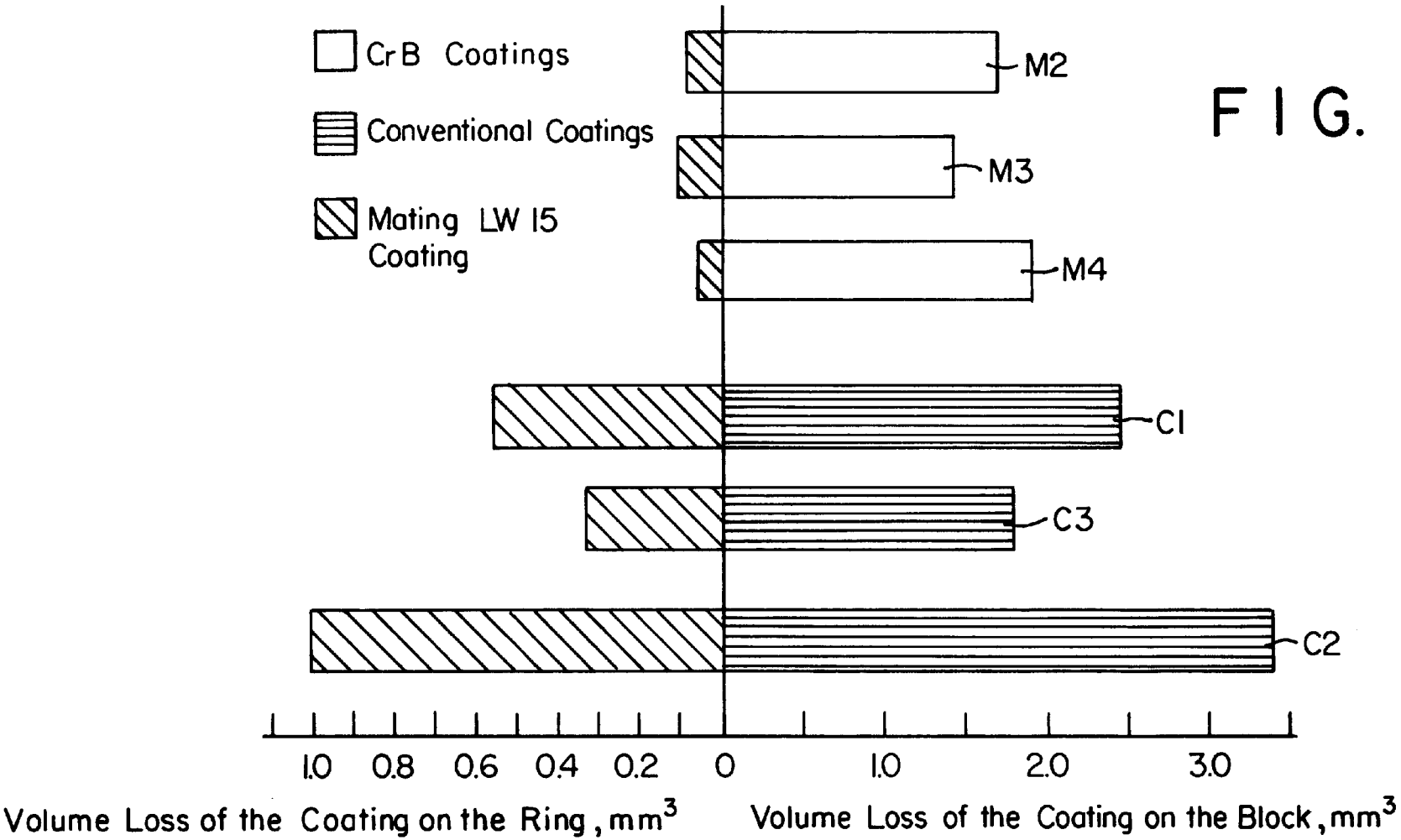
FIG. 2 is a bar graph showing the adhesive wear resistance of various coatings mated against a conventional detonation gun tungsten carbide based coating.

The bar graphs of FIG. 2 show comparisons in the volume loss between chromium boride coatings and conventional alloy coatings against mating UCAR LW-15 coatings. The CrB coatings M2, M3 and M4 representing those prepared from mix formulations (2), (3) and (4), respectively, are superior to the conventional alloy coatings C1 and C2 and comparable to or better than conventional coatings C3. The volume loss of LW-15 coatings when mating against CrB coatings is 3 to 10 times less than those mated against the conventional alloy coatings.

The microstructures of sections parallel and perpendicular

Figure 6A:
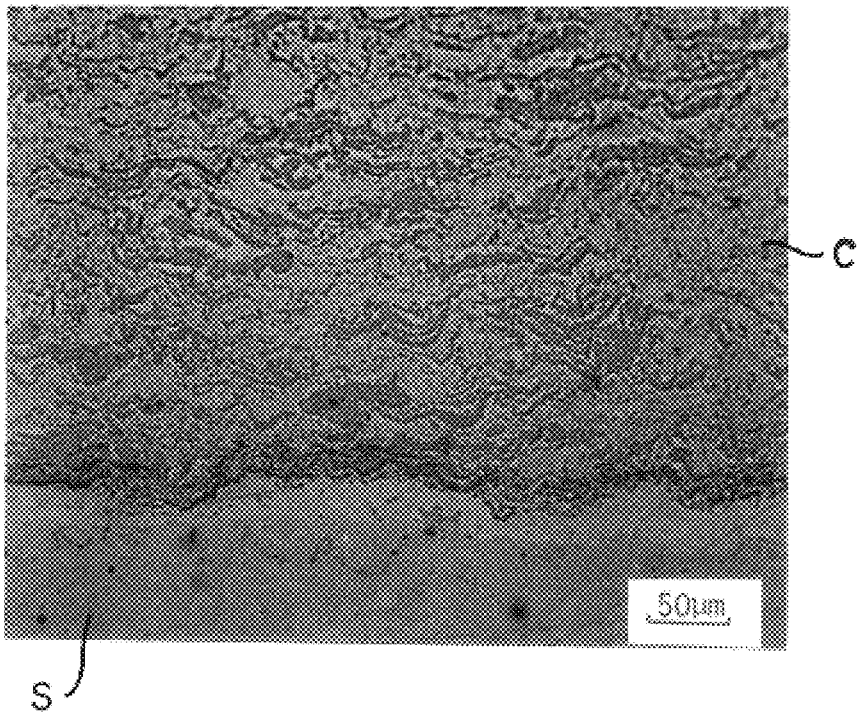
Figure 6B:
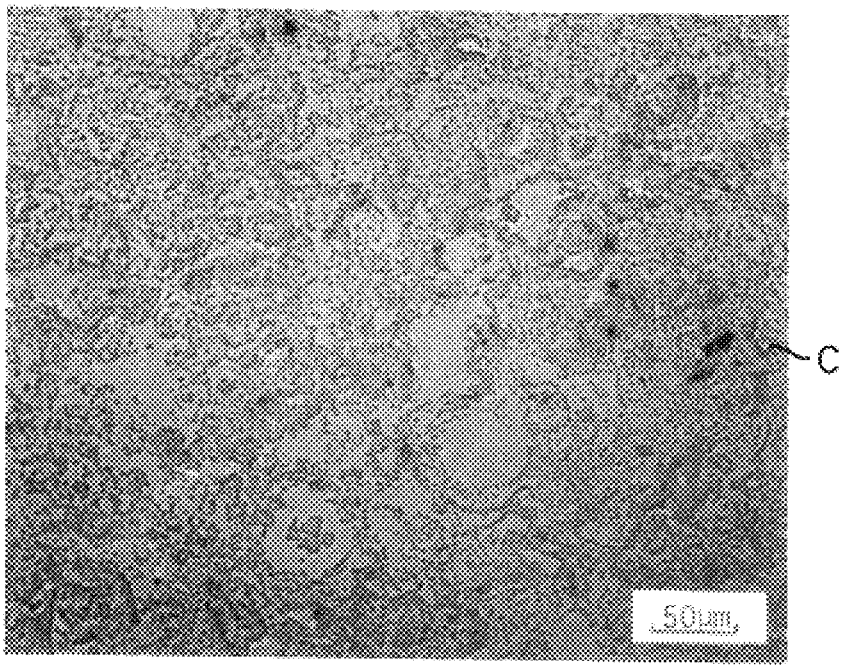

CrB of 13.4, 15.5 and 19.7% respectively, as shown in FIGS. 3(*a*), 4(*a*) and 5(*a*). The microstructures of the coatings made from the remaining mix formulations (4) and (5) reveal that the precipitates of chromium boride aggregate as lamellar clusters distributed throughout the matrix as shown in FIGS. 6(*a*) and 7(*a*). These coatings had a CrB volume fraction of 32.5 and 42.6 percent, respectively.

The section of the coatings parallel to the surface is generally exposed to the wear environment. It is therefore expected that the coating microstructure in the section parallel to the surface has a significant influence on the wear behavior of a particular coating. FIGS. 3(*b*) to 7(*b*), inclusive, show the microstructure of the sections parallel to the surface of the coatings made from mix formulations (1) through (5), respectively, and reveal basically the same type of precipitation as occurs in the sections perpendicular to the surface of the coatings. The coatings made from mix formulations (1), (2) and (3) having CrB volume fraction of 13.4, 15.5 and 19.7% exhibit a substantially uniform precipitation of the chromium boride throughout the matrix as shown in FIGS. 3(*b*), 4(*b*) and 5(*b*). In the remaining coatings made from the other mix formulations (4) and (5), the precipitates aggregated in clusters which were distributed evenly throughout the matrix as shown in FIGS. 6(*b*) and 7(*b*). These coatings had a volume fraction greater than 30 percent.

Figure 8A:
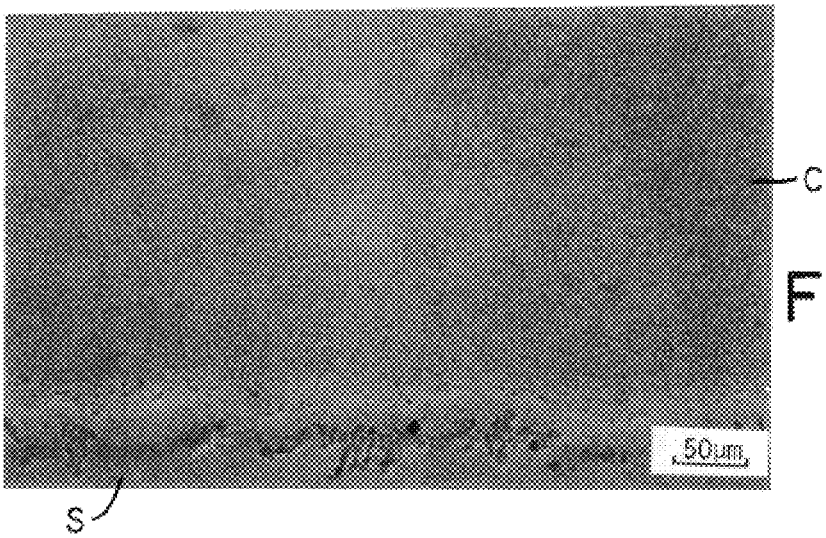
FIGS. 8(*a*), (*b*) and (*c*) are photomicrographs taken at a magnification of 200× showing the microstructure of a section perpendicular to the surface of conventional coatings of the prior art.
Figure 8B:
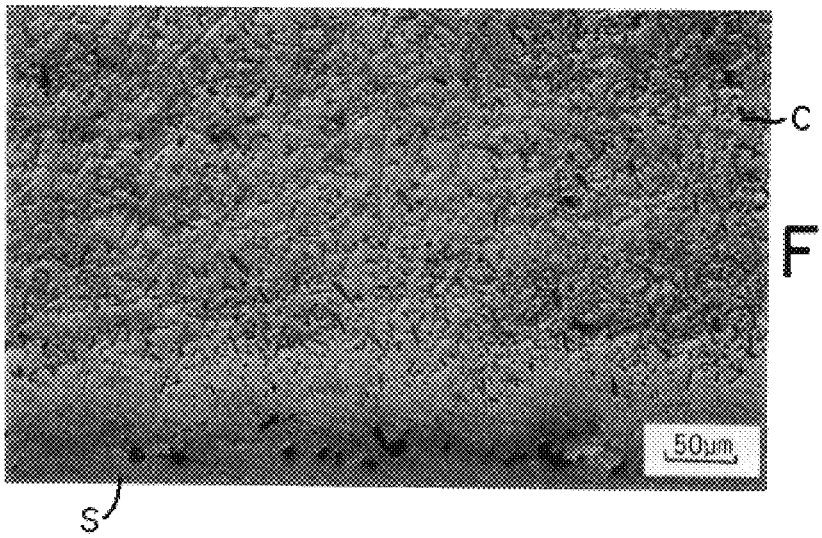
Figure 8C:
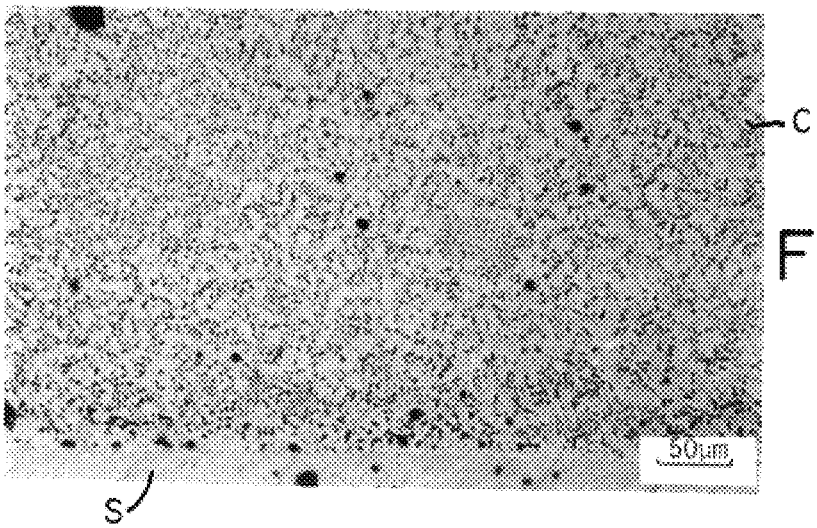

For comparison, the microstructures of sections perpendicular to the surface of conventional plasma sprayed and heat treated C1 and C2 coatings and weld-deposited C3 coatings are shown in FIGS. 8(*a*), (*b*) and (*c*), respectively. Since these conventional alloy coatings were made by using a prealloyed powder, the microstructure of the section parallel to the surface of each coating is expected to be the same as that of the section perpendicular to the surface. For coatings C1, relatively high boron and low chromium content result in the formation of very fine $Ni_3B$ structure as the primary hard phase. For coatings C2, the chromium boride precipitates are in a needle shape as shown in FIG. 8(*b*). In the weld deposited coatings C3, the CrB precipitates are blocky with a particle size of about 3 micrometers.

The morphology and particle size of the chromium boride precipitates were also examined in sections parallel to the surface of the CrB coatings by scanning electron microscope (SEM). It was found that both the morphology and particle size of the chromium boride precipitates depend upon the formation mechanism. Coatings made with two powder components, i.e., a low melting boron-containing nickel base alloy and nickel-20 chromium or chromium metal, had a more uniform distribution of the precipitates than those made with three components, i.e., boron-containing alloy, nickel-20 chromium and chromium metal. For the coatings containing CrB volume fractions of 13.4, 15.5 and 19.7%, diffusion reaction between boron from the low melting nickel base alloy and chromium in the Ni-20 chromium solid solution result in rod or plate-like CrB precipitates with an average size of about 0.5 micrometers (in length of rod or diameter of platelet).

In coatings made with two powder components using mix formulation (5) and having a CrB volume fraction of 42.6%, diffusion reaction between boron from the low melting alloy and pure chromium leads to the formation of blocky CrB precipitates with a particle size of 1 to 5 micrometers. In coatings made with three powder components using mix formulation (4) and having a CrB volume fraction of 32.5%, the formation of precipitates was controlled by both mechanisms mentioned above. Therefore, fine plate-like CrB precipitates formed in the matrix between boride clusters which contained blocky precipitates with a particle size of 1 to 5 micrometers.

We claim:

1. A wear and corrosion resistant coating on a substrate, said coating comprising multiple, thin, irregularly shaped splats overlapping and bonded to one another and to said substrate, said splats comprising hard, ultrafine, chromium boride particles dispersed in a metal matrix, the particles having an average particle size of less than about one micron and consitituting less than about 30 volume percent of the coating, the balance being metal matrix.

2. A coating according to claim 1 wherein the chromium boride particles constitute from about 12 to about 30 volume percent of the coating.

3. A coating according to claim 2 wherein the chromium boride particles constitute from about 15 to about 25 volume percent of the coating.

4. A coating according to claim 1 wherein the atomic ratio of chromium to boron in said coating is between about 0.8 and 1.5.

5. A coating according to claim 1 wherein the average size of said particles ranges from about 0.1 to about 1.0 micron.

6. A coating according to claim 1 having a hardness from about 250 to about 700 $DPH_{300}$ (HV.3).

7. A coating according to claim 1 wherein the metal matrix is nickel.

8. A coating according to claim 7 wherein the metal matrix is a nickel base alloy containing a metal selected from the group consisting of chromium, silicon, phosphorus, aluminum, manganese, cobalt and iron.

9. A coating according to claim 1 having a thickness within the range of from about 0.005 to about 0.040 inch.

10. A coating according to claim 1 wherein the substrate is a material selected from the group consisting of steel, stainless steel, iron base alloys, nickel, nickel base alloys, cobalt, cobalt base alloys, chromium, chromium base alloys, titanium, titanium base alloys, refractory metals and refractory-metal base alloys.

11. A coating according to claim 10 wherein the substrate is a steel.

12. A coating according to claim 10 wherein the substrate is AISI 4140 steel.

13. A coating according to claim 10 wherein the substrate is AISI 4130 steel.

14. A coating according to claim 10 wherein the substrate is AISI 410 stainless steel, and wherein the chromium boride particles constitute less than about 20 volume percent of said coating.

15. A process for producing a wear and corrosion resistant coating on a substrate comprising: depositing a mechanically blended powder mixture of at least two components including a first component containing chromium and a second component containing a boron-containing alloy onto said substrate and then heating the as-deposited coating to an elevated temperature sufficient to effect a diffusion reaction between the deposited elments resulting in the formation of ultrafine chromium boride particles dispersed in a metal matrix.

16. A process according to claim 15 wherein the mechanically blended powder mixture is deposited onto said substrate by plasma spraying.

17. A process according to claim 15 wherein the amounts of chromium and boron-containing alloy employed in said mixture are such that the chromium boride particles constitute from about 12 to about 30 volume percent of the coating.

18. A process according to claim 15 wherein the amounts of chromium and boron-containing alloy employed in said mixture are such that the chromium boride particles constitute from about 15 to about 25 volume percent of the coating.

19. A process according to claim 15 wherein the atomic ratio of chromium to boron in said powder mixture is between about 0.8 and 1.5.

20. A process according to claim 15 wherein the powder mixture has a particle size of less than about 200 mesh.

21. A process according to claim 15 wherein the boron-containing alloy is a nickel base alloy.

22. A process according to claim 21 wherein the boron-containing alloy includes and at least one metal selected from the group consisting of chromium, silicon, phosphorous, aluminum, manganese, cobalt and iron.

23. A process according to claim 20 wherein the boron-containing alloy comprises from about 2.5 to about 10 wt. % boron, 0 to about 25 wt. % chromium, 0 to about 2 wt. % manganese, 0 to about 2 wt. % aluminum, 0 to about 1 wt. % carbon, 0 to about 5 wt. % silicon, 0 to about 5 wt. % phosphorous, 0 to about 2 wt. % copper and 0 to about 5 wt. % iron, the balance nickel.

24. A process according to claim 22 wherein the boron-containing alloy comprises about 3 wt. % boron, about 7 wt. % chromium, about 4 wt. % silicon, and about 4 wt. % iron, the balance nickel.

25. A process according to claim 22 wherein the boron-containing alloy comprises about 7.3 wt. % boron, about 3.2 wt. % chromium and about 2.6 wt. % silicon, the balance nickel.

26. A process according to claim 22 wherein the boron-containing alloy comprises about 8.9 wt. % boron, about 3.0 wt. % chromium, about 2.2 wt. % silicon and about 2.7 wt. % iron, the balance nickel.

27. A process according to claim 15 wherein the as-deposited coating is heat treated in vacuum or an inert gas.

28. A process according to claim 15 wherein the as-deposited coating is heated to a temperature of between about 900 and 1100° C.

29. A process according to claim 15 wherein the diffusion reaction proceeds according to the following equation:

$$Cr+(M_1—B)\rightarrow CrB+M_1$$

wherein $M_1$ is nickel and optionally one or more metals selected from the group consisting of chromium, silicon, phosphorus, aluminum, manganese, cobalt and iron; and B is boron.

30. A process according to claim 15 wherein the diffusion reaction proceeds according to the following equation:

$$(M_2—Cr)+(M_1—B)\rightarrow CrB+(M_1—M_2)$$

wherein $M_1$ and $M_2$ are nickel and optionally one or more metals selected from the group consisting of chromium, silicon, phosphorus, aluminum, manganese, cobalt and iron; and B is boron.

31. A process according to claim 15 wherein the diffusion reaction proceeds according to the following equation:

$$Cr+(M_1—B)+(M_2—Cr)\rightarrow CrB+(M_1—M_2—Cr)$$

wherein $M_1$ and $M_2$ are nickel and optionally one or more metals selected from the group consisting of chromium, silicon, phosphorus, aluminum, manganese, cobalt and iron; and B is boron.

32. A process according to claim 15 wherein the substrate is composed of material selected from the group consisting of steel, stainless steel, iron base alloys, nickel, nickel base alloys, cobalt, cobalt base alloys, chromium, chromium base alloys, titanium, titanium base alloys, refractory metals and refractory metal base alloys.

33. A process according to claim 32 wherein the substrate is a low carbon steel.

34. A process according to claim 32 wherein the substrate is AISI 4140 steel.

35. A process according to claim 32 wherein the substrate is AISI 4130.

36. A process according to claim 32 wherein the substrate is AISI 410 stainless steel.

37. A composition for producing a coating comprising a mechanically blended powder mixture of at least two components including a first component containing chromium and a second component containing a boron-containing alloy, the atomic ratio of chromium to boron in said mixture being between about 0.8 and 1.5.

38. A composition for producing a coating according to claim 37 wherein the amounts of chromium and boron containing alloy employed in said mixture are such that from about 12 to about 30 volume percent of the coating comprises chromium boride particles.

39. A composition for producing a coating according to claim 37 wherein the amounts of chromium and boron-containing alloy employed in said mixture are such that from about 15 to about 25 volume percent of the coating comprises chromium boride particles.

40. A composition for producing a coating according to claim 37 wherein the boron-containing alloy is a nickel base alloy.

41. A composition for producing a coating according to claim 40 wherein the boron-containing alloy includes one or more metals selected from the group consisting of chromium, silicon, phosphorus, aluminum, manganese, cobalt and iron.

42. A composition for producing a coating according to claim 41 wherein the boron-containing alloy comprises from about 2.5 to about 10 wt. % boron, 0 to about 25 wt. % chromium, 0 to about 2 wt. % manganese, 0 to about 2 wt. % aluminum, 0 to about 1 wt. % carbon, 0 to about 5 wt. % silicon, 0 to about 5 wt. % phosphorus, 0 to about 2 wt. % copper and 0 to about 5 wt. % iron, the balance being nickel.

43. A composition for producing a coating according to claim 42 wherein the boron-containing alloy comprises about 3 wt. % boron, about 7 wt. % chromium, about 4 wt. % silicon, about 4 wt. % iron, the balance being nickel.

44. A composition for producing a coating according to claim 42 wherein the boron-containing alloy comprises about 7.3 wt. % boron, about 3.2 wt. % chromium and about 2.6 wt. % silicon, the balance being nickel.

45. A composition for producing a coating according to claim 42 wherein the boron-containing alloy comprises about 8.9 wt. % boron, 3.0 wt. % chromium, about 2.2 wt. % silicon, about 2.7 wt. % iron, the balance being nickel.

* * * * *

UNITED STATES PATENT AND TRADEMARK OFFICE

CERTIFICATE OF CORRECTION

PATENT NO. : 6,007,922
DATED : December 28, 1999
INVENTOR(S) : Sue et al.

It is certified that error appears in the above-identified patent and that said Letters Patent is hereby corrected as shown below:

Title page,
Item [73], Assignee, delete "Union Carbide Coatings Service Corporation" and insert -- Praxair S.T. Technology, Inc. --.

Signed and Sealed this

First Day of April, 2003

JAMES E. ROGAN
*Director of the United States Patent and Trademark Office*